US007707013B2

(12) United States Patent
Valdez et al.

(10) Patent No.: US 7,707,013 B2
(45) Date of Patent: Apr. 27, 2010

(54) METHOD FOR ESTIMATING MINIMUM MISCIBILITY ENRICHMENT

(75) Inventors: Ŕaul Valdez, Bellaire, TX (US); Peter Harold Doe, Richmond, TX (US); Tak Siang Kho, Houston, TX (US)

(73) Assignee: Shell Oil Company, Houston, TX (US)

( * ) Notice: Subject to any disclaimer, the term of this patent is extended or adjusted under 35 U.S.C. 154(b) by 533 days.

(21) Appl. No.: 11/566,556

(22) Filed: Dec. 4, 2006

(65) Prior Publication Data

US 2007/0143026 A1 Jun. 21, 2007

Related U.S. Application Data

(60) Provisional application No. 60/742,235, filed on Dec. 5, 2005.

(51) Int. Cl.
*G06F 17/50* (2006.01)
*G06G 7/48* (2006.01)
*E21B 43/16* (2006.01)

(52) U.S. Cl. ..... 703/2; 703/10; 166/268; 166/402; 166/403

(58) Field of Classification Search ..... 703/2, 703/10; 166/402, 403, 268
See application file for complete search history.

(56) References Cited

U.S. PATENT DOCUMENTS 4,570,712 A * 2/1986 Kokolis ..... 166/403
4,628,999 A * 12/1986 Kiss et al. ..... 166/402
5,711,373 A * 1/1998 Lange ..... 166/252.2

OTHER PUBLICATIONS

Jean-Noël Jaubert et al., "Characterization of Heavy Oils. 3. Prediction of Gas Injection Behavior: Swelling Test, Multicontact Test, Multiple-Contact Minimum Miscibility Pressure, and Multiple-Contact Minimum Miscibility Enrichment", Industrial & Engineering Chemical Research, vol. 34, Nov. 1995, pp. 4016-4032.*

Odd Magne Mathiassen, "CO2 as Injection Gas for Enhanced Oil Recovery and Estimation of the Potential on the Norwegian Continental Shelf", Norwegian Petroleum Directorate. Master of Science Thesis, Norwegian University of Science and Technology, Trondheim. May 2003.*

SPE97613 "Gas Injection Feasibility Study of the Baram Delta Fields, Malaysia".

* cited by examiner

*Primary Examiner*—Thai Phan
(74) *Attorney, Agent, or Firm*—William E. Hickman

(57) ABSTRACT

A method for estimating minimum miscibility enrichment (MME) for an injectant used in gas flooding of a reservoir at a given operating pressure comprising performing a plurality of slim tube simulations for the reservoir, determining minimum miscibility pressure (MMP) for a plurality of injected gases, creating a plot of recovery factor (RF) vs. 1−(MMP−P)/MMP wherein P is the operating pressure of the reservoir having at least one of the plurality of injected gases, wherein 1−(MMP−P)/MMP is a dimensionless pressure, wherein the plot has a y-intercept and slope, obtaining a recovery factor equation RF=i+s(1−(MMP−P)/MMP) wherein i is the y-intercept and s is the slope, determining a value for i, determining a value for s and calculating the recovery factor.

6 Claims, 4 Drawing Sheets

METHOD FOR ESTIMATING MINIMUM MISCIBILITY ENRICHMENT

CROSS REFERENCE TO RELATED APPLICATION

This application claims priority to U.S. Provisional Application Ser. No. 60/742,235 filed Dec. 5, 2005, the entire disclosure of which is herein incorporated by reference.

FIELD OF INVENTION

The present invention relates to a method for estimating minimum miscibility enrichment for an injectant in an enhanced oil recovery candidate reservoir.

BACKGROUND

Producing hydrocarbons from an underground reservoir requires those fluids to be driven to the producing wells, and then lifted several hundred meters against the force of gravity. The large-scale behavior of a reservoir can be described by considering the drive energy of the reservoir and its surroundings. The producing lifetime of a reservoir may generally be categorized as follows:

Primary recovery: where the natural drive energy locked up in the reservoir and its surroundings is used to produce hydrocarbons Secondary recovery: where the natural drive energy of the reservoir is supplemented by injection of a fluid, normally water or gas Tertiary recovery: where residual hydrocarbons trapped after conventional secondary recovery techniques are mobilized by the injection of fluids that are not normally found in the reservoir (e.g. surfactants, steam, and polymers)

Enhanced oil recovery (EOR) involves methods of recovering more oil from a reservoir than can be obtained from the naturally occurring drive mechanisms such as solution gas drive (fluid expansion) or water influx. EOR involves the introduction of artificial/supplemental forces or energy into the reservoir for the purpose of aiding the natural drive mechanisms. EOR can occur at any stage in the production life, although it is usually relegated to secondary or tertiary aspects. Some types of EOR include water flooding, gas flooding, steam injection, and carbon dioxide injection.

Planning an EOR project demands meticulous attention to the various factors that influence the selection of an EOR candidate. Although EOR is a powerful technique for recovering more hydrocarbons from a producing reservoir, it is not always a commercially viable option. Traditionally the EOR potential of candidate reservoirs is evaluated using classical reservoir engineering techniques. Engineers quantify EOR potential one field at a time using numerical methods and field specific data. This process can be very time-consuming and often yields inaccurate or incomplete results. For purposes of this application, "gas flooding" refers to gas injected to access oil not accessible to a waterflood. In a gas flooding operation, "injected gas" refers to the gas injected. "Injectant" refers to an enriching agent such as propane, butane, hydrogen sulfide, or other substances added to the gas injected to improve recovery.

SUMMARY OF THE INVENTION

The present inventions include method for estimating minimum miscibility enrichment (MME) for an injectant used in gas flooding of a reservoir at a given operating pressure comprising performing a plurality of slim tube simulations for the reservoir, determining minimum miscibility pressure (MMP) for a plurality of injected gases, creating a plot of recovery factor (RF) vs. 1−(MMP−P)/MMP wherein P is the operating pressure of the reservoir having at least one of the plurality of injected gases, wherein 1−(MMP−P)/MMP is a dimensionless pressure, wherein the plot has having a y-intercept and slope, obtaining a recovery factor equation RF=i+s(1−(MMP−P)/MMP) wherein i is the y-intercept and s is the slope, determining a value for i, determining a value for s and calculating the recovery factor.

BRIEF DESCRIPTON OF FIGURES

DETAILED DESCRIPTION

Figure 1:
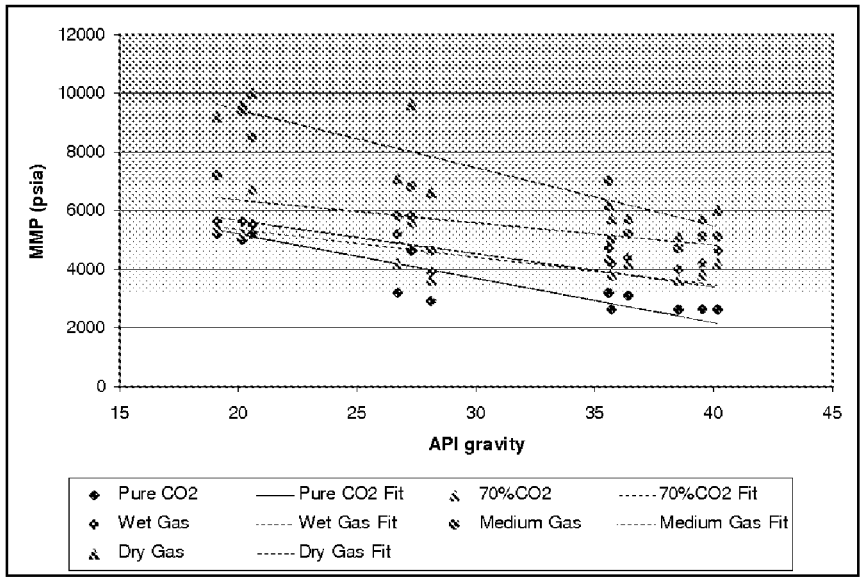
FIG. 1 shows a linear correlation of MMP versus API gravity for the five injectants.
Figure 2:
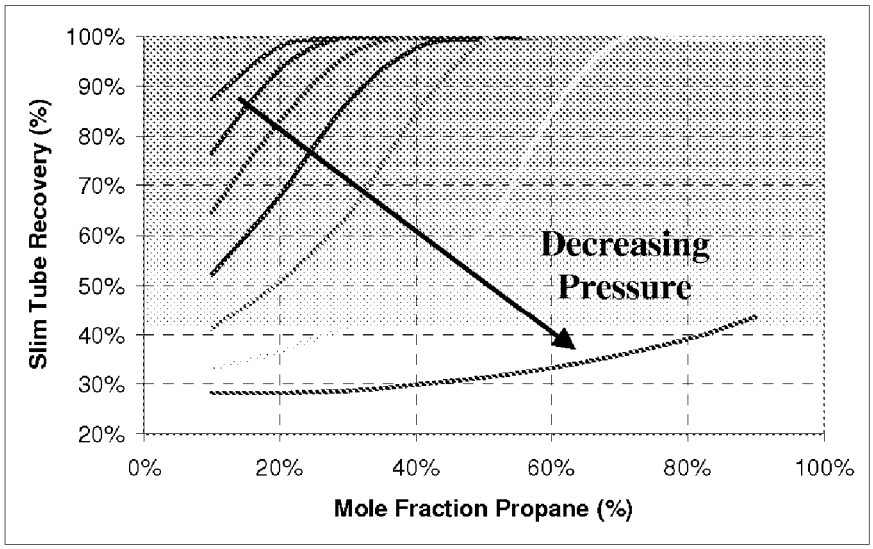
FIG. 2 shows an example set of slim tube simulation results for an enrichment experiment.

For purposes of this application, "gas flooding" refers to gas injected to access oil not accessible to a waterflood. In a gas flooding operation, "injected gas" refers to the gas injected. "Injectant" refers to an enriching agent such as propane, butane, hydrogen sulfide, and others added to the gas injected to improve recovery. "Target oil" is defined as the remaining oil in the reservoir, which is accessible by a gas flood. Target oil represents the EOR potential for a reservoir based on the volumetric sweep efficiency, the remaining oil saturation at a given watercut and a discount factor applied to account for the decrease in slim tube recovery at pressures lower than MMP. "Volumetric sweep" is defined as the volume of the swept zone divided by the total reservoir volume. Minimum miscibility pressure ("MMP") is defined as the minimum pressure required for achieving miscibility. Minimum miscibility enrichment ("MME") is defined as the mole fraction of propane (or other enriching agent such as butane, hydrogen sulfide, or others required to reach miscibility at a given pressure. "Recovery factor" refers to the slim tube recovery factor discussed that discounts recovery for cases with operating pressure below MMP. "STOIIP" stands for stock tank oil initially in place, and is defined as the stock barrels of oil initially in place.

Some basic concepts underpin the process of screening for an EOR candidate reservoir.

Oil and gas reservoirs contain both water and hydrocarbon, with the distribution of these fluids being controlled initially by a balance between gravity and capillary forces. Oil and water are immiscible which gives rise to a capillary force and thus a tension exists at the fluid interface. The forces required to move interfaces prevents oil from completely displacing water, leaving connate water saturation. These same forces also do not allow water imbibing back into the pore throat, either through water flooding or aquifer influx, to completely displace oil, leaving residual oil saturation.

Ideal recovery would then be the difference between initial and residual oil saturation, however in practice, recoveries are then controlled by two factors: (1) mobility ratio and (2) economic limit. Oil/water mobility ratio compares oil and water viscosities and relative permeability at a given saturation. Favorable mobility occurs when the viscosities of the oil and water are similar and unfavorable mobility occurs when there are large differences in viscosities, resulting in lower recovery factors for a similar pore volume injected. Economic limit, such as producing watercut or minimum oil production rate, affect the ultimate recovery of a reservoir, leaving behind remaining oil saturation—typically higher than the residual.

Understanding volumetric sweep efficiency is key to understanding how much of the reservoir oil has been contacted by a flood mechanism. Volumetric sweep efficiency is a combination of vertical and areal sweeps. Very discontinuous reservoirs have low areal sweep efficiency as they tend to be compartmentalized and require dense well spacing. Well-connected, laterally continuous reservoirs exhibit good communication between wells and typically require fewer wells, therefore high areal sweep efficiency. Reservoirs with large permeability variations or high Dysktra-Parsons coefficient (Vdp), a statistical quantification of how permeability varies in a given sample, flood out layers preferentially. Whereas reservoirs with low permeability variation tend to flood layers more uniformly. Permeability contrast controls vertical sweep efficiency. For purposes of screening, neither quantity can be calculated independently for each reservoir.

Unlike water and oil, gas and oil are mutually soluble at certain conditions. When gas and oil are soluble, the interfacial tension is significantly reduced allowing for ideal displacement. Few gases are instantly soluble in oil or first contact miscible. Most commercial gas injection projects undergo a more complex process of mixing either through vaporizing or condensing oil components into a gas rich phase continually over multiple contacts creating a transitional phase that has little to no interfacial tension with oil and the capillary forces that trap oil in the oil/water system cease to exist. The degree of solubility is a function of the oil and gas compositions and reservoir pressure and temperature. The minimum pressure required achieving miscibility is typically determined using laboratory slim tube experiments.

For many reservoirs, miscibility cannot be realistically achieved without fracturing the reservoir or injecting at unreasonably high surface pressures. To improve the miscible behavior at current reservoir conditions for a given solvent, oil components, such as propane, butane, hydrogen sulfide, or other substances can be added to "enrich" the gas. Propane and other intermediate components are known to improve, in this case lower, the required miscibility pressure.

Gravity segregation will impact vertical sweep efficiency and is captured in the overall sweep efficiency estimate. However, gas injected is typically less dense and less viscous than oil or water and therefore will have a tendency to flow vertically. In horizontal floods, gas migration to the uppermost reservoirs could reduce the vertical sweep efficiency. The effects are more pronounced in high permeability and or vertically continuous reservoirs. If known to be an issue, two options exist: (1) reduce pattern spacing or (2) increase injection rate.

In viscous dominated reservoirs, target oil is a function of remaining oil saturation water swept zones because a tendency is for a gas flood to follow the flow paths created by a preceding waterdrive. Target oil is by far the most critical parameter to understand when considering a gas flood. Based upon experience, attractive oil targets exceed 25% remaining oil saturation in swept zones. A less than expected target oil will undoubtedly worsen the efficiency, defined as the volume of gas required per incremental barrel recovered.

Sweep and gravity segregation calculations provide a good first step; however to better understand a gas flood, areal full field static and dynamic models are more suitable. Furthermore, to better understand the effects of vertical heterogeneity, smaller, more detailed models are useful for understanding processes in some embodiments of the invention.

Full implementation of gas flooding will often require new investment in facilities and wells. This investment decision will be supported by the results of a gas injection pilot.

One embodiment of the invention using four levels of screening to synthesize field data into a manageable number of opportunities is described below:

- Level 1: Limit the target reservoirs to those with significant long range EOR potential
- Level 2: Limit the pilot targets to those most likely to achieve miscibility
- Level 3: Limit pilot choices to locations with suitable gas sources and well availability, and where production or monitored response is within the available time frame
- Level 4: Select the highest-ranking options in level 3 and build prototype models to estimate gas flood performance In some embodiments of the invention, a method for selecting a candidate reservoir for enhanced oil recovery from a plurality of reservoirs comprises selecting a reservoir, calculating a normalized raw score based on target oil for the reservoir ($S_{Target\ Oil}$) and calculating a normalized raw score based on recovery factor for the reservoir ($S_{Recovery\ Factor}$). The method may further include calculating a normalized raw score based on time frame for injection ($S_{Timing}$), calculating a normalized raw score based on Lake Gravity number for the reservoir ($S_{Gravity}$), calculating a normalized raw score based on spacing for wells in the reservoir ($S_{Wells}$), and/or calculating a normalized raw score based on facilities ($S_{Facilities}$). These scores are then each multiplied by a respective weighting factor and added together to obtain a total score for the reservoir. The total scores of each reservoir are then compared to total scores for other reservoirs and a ranked list of the candidate reservoirs is produced.

Advantages of some embodiments of the invention may include one or more of the following:

- Quick screening of a large number of candidates
- Ability to calculate the recovery factor under immiscible conditions
- Emphasis on the use of actual performance data to predict EOR potential
- Flexible enough to allow for review of basin-wide potential as well as generation of a candidate list for pilot consideration
- Includes notional pilot costs
- Screening tool allows user to define screening criteria Those of skill in the art will appreciate that many modifications and variations are possible in terms of the disclosed embodiments, configurations, materials, and methods without departing from their spirit and scope. Accordingly, the scope of the claims appended hereafter and their functional equivalents should not be limited by particular embodiments described and illustrated herein, as these are merely exemplary in nature.

EXAMPLE

A screening approach was presented that estimates EOR potential under gas flooding under various reservoir conditions using different solvents for Baram Delta (BDO) reservoirs. The customized screening tool allowed for rapid screening of over 1,000 candidates.

The nine offshore Baram Delta fields were discovered in 1969, and contain an estimated 4,000+ MM stock tank barrels in place ranging in gravity between 20 and 40 API. The productive reservoirs range in depth from 2,000 to 9,000 ftss. Historical production rates have been relatively flat at 80-100,000 barrels of oil per day maintained primarily through infill drilling and new infield development and/or expansion. Most reservoirs are supported by strong aquifer drives with two notable exceptions at Baronia (RV2 reservoir)—currently under waterflood, and several Baram reservoirs currently under depletion.

After 30 years of production, several of the large producing reservoirs have achieved high recovery efficiencies (>45%) and have begun producing at high watercuts. Reviewing published data, by the Journal of Petroleum Technology on EOR, suggests that gas flooding is appropriate for commercial EOR projects in the depth and API range of most BDO fields.

Due to the large number of reservoirs to be considered, a systematic approach was developed to provide a hierarchical screening, which includes the following objectives:

1. Assess the full EOR potential for both miscible and immiscible gas flooding
2. List reservoirs in order of attractiveness for eventual full scale gas injection
3. Identify a suitable location for a gas EOR pilot & identify a suitable injectant to use for the pilot

1. Assess the Full EOR Ptential for Both Miscible and Immiscible Gas Flooding

Estimating Miscibility Pressure

No actual MMP data for BDO oils was available for this screening exercise. Twelve old, in some cases 30 years old, PVT datasets spanning a wide range of API (20-40 API) were available and modeled with an equation-of-state PVT modeling package. Regression on the parameters of the equation of state model was used to obtain matches to the experimental data.

Fourteen component models were then converted into input for a simulator for which a slim tube model was available. Slim tube experiments were performed for each oil at various pressures and injectants.

Linear correlations between API gravity and simulated MMP, shown in FIG. 1, were developed to estimate MMP for reservoirs with only API and no PVT data.

$$MMP=A+B*API \tag{1}$$

The values for A and B are given below in Table 1.

TABLE 1

A and B fitting parameters

| Injectant | A | B |
|---|---|---|
| CO2 | 8503.4 | −154.9 |
| 70% CO2, 30% C1 | 7204.1 | −93.4 |
| Wet HC Gas | 7886.5 | −112.4 |
| Mid HC Gas | 7871.6 | −76.5 |
| Dry HC Gas | 13398.0 | −197.8 |

Recovery Factor and MME

To develop correlations for all injectants, a more useful quantity to plot against is a dimensionless scaled pressure, $P_{dim}$, which is written as the following expression:, 1 −(MMP−P)/MMP, wherein P is the operating pressure.

Figure 3:
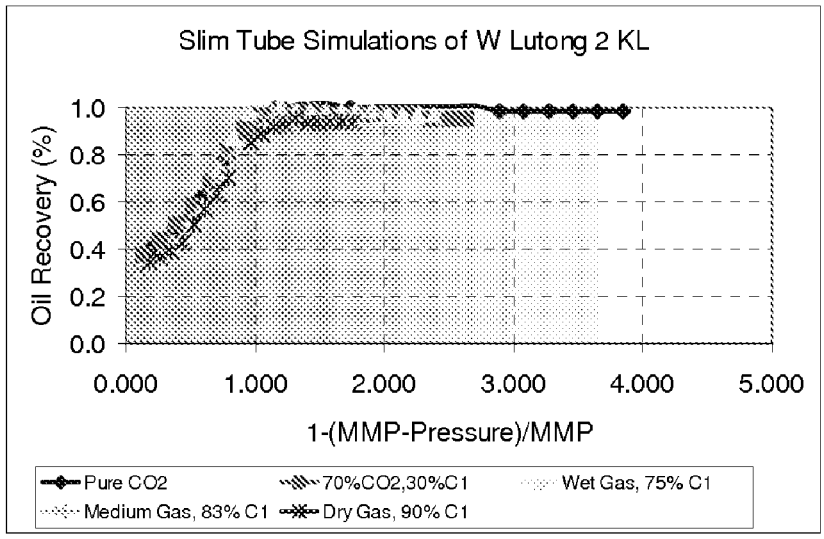
FIG. 3 shows recovery factor versus dimensionless pressure for West Lutong K/L oil and all injectant gases.

All recovery curves tend to collapse into one curve, as shown in FIG. 3, from which the following correlation was developed:

$$RF=i+s(1-(MMP-P)/MMP) \tag{3}$$

Figure 4:
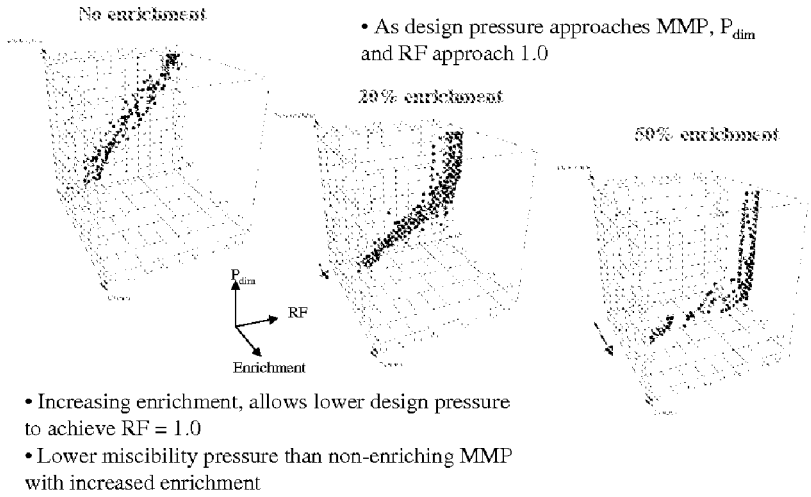
FIG. 4 shows recovery factor versus dimensionless pressure and enrichment (0%, 20% and 50% propane enrichment) for all oils.

Similarly, plotting the scaled pressure, $P_{dim}$, versus recovery factor for the enrichment cases shows a similar behavior as shown in FIG. 4.

Figure 5:
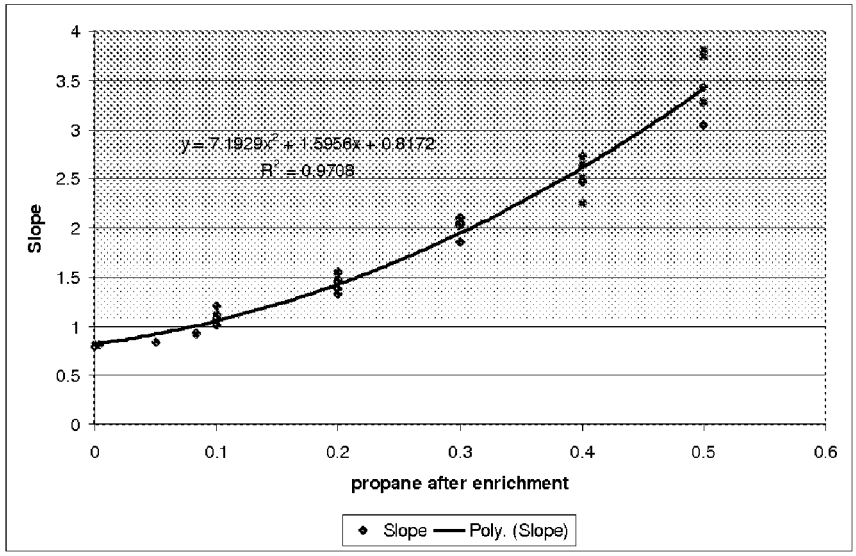
FIG. 5 shows the slope of slim tube recovery factor versus dimensionless pressure plot, plotted versus propane mole fraction of the enriched gas.
Figure 6:
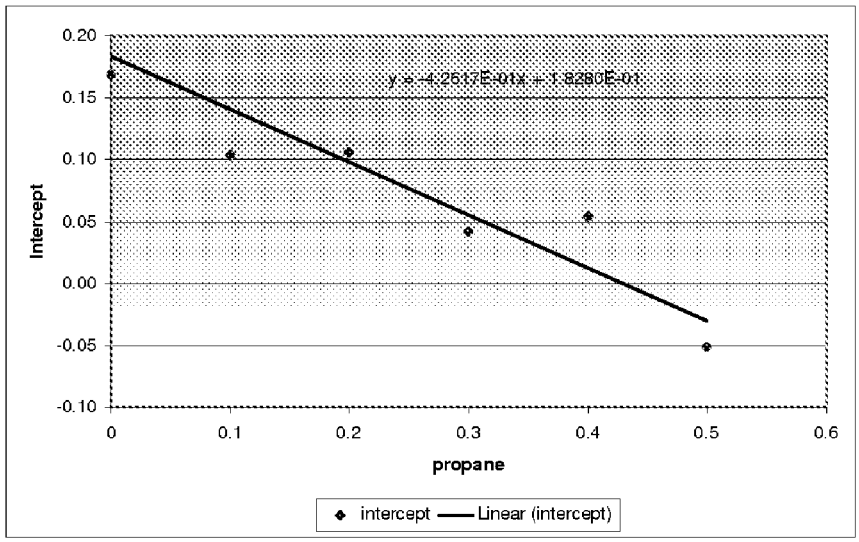
FIG. 6 shows the intercept of the slim tube recovery factor versus dimensionless pressure plot, plotted versus propane mole fraction of enriched gas.

For screening purposes, one function was derived based on all data, both enriched and non-enriched gas. Any given slim tube simulation can then be characterized by its MMP, slope and intercept of recovery factor versus dimensionless pressure as shown in FIG. 5 and FIG. 6, and maximum recovery factor. The following equations for i and s are as follows where $X_{C3}$ is the mole fraction of propane in the injected gas:

$$i=0.1828-0.42617X_{C3} \tag{4}$$

$$s=0.8172+1.5956X_{C3}+7.1929X_{C3}^2 \tag{5}$$

Recovery factor for any pressure and propane enrichment can now be calculated. To calculate MME level, the equations were rearranged first calculating $MMP_{ne}$ for the non-enriched gas at the operating pressure, $P_{op}$:

$$P_d = 1 - \frac{(MMP_{ne} - P_{op})}{MMP_{ne}} \tag{6}$$

Expanding equation (3) yields the following equation, where $RF_{ne}$ is the estimated recovery at $P_{op}$ and $X_{C3,ne}$ is the mole fraction of propane in the non-enriched gas:

$$RF_{ne}=0.1828-0.4262X_{C3,ne}+(0.8172+1.5956X_{C3,ne}+7.1929X_{C3,ne}^2)P_d \tag{7}$$

By definition, MME is the mole fraction of propane required to reach miscibility or when $P=P_{op}$. Setting the $RF_{ne}=RF_{max}$ yields the following equation for which $X_{MME}$ can be solved:

$$7.1929P_dX_{MME}^2+(1.5956P_d-0.4262)X_{MME}+(0.1828+0.8172P_d-RF_{max})=0 \tag{8}$$

Volumetric Sweep

Assuming no recovery from unswept zones, the sweep is the estimated ultimate recovery (EUR) divided by the recovery factor in the swept zone at a given watercut.

$$E_s = \frac{EUR}{1 - \frac{\overline{S}_0}{S_{oi}}} \tag{9}$$

EUR can be estimated from water drive performance and $S_{oi}$ can be derived from saturation height function modeling. In this example, permeability, porosity and capillary pressure data is not available for every reservoir, therefore for screening, $S_{oi}$ is taken to be 82% based on saturation-height modeling of typical BDO sandstone, 300-600 md permeability.

Classic Buckley-Leverett (1942) and Welge (1952) techniques were used to estimate remaining oil saturation or $\overline{S}_o$ in the swept zone. For fractional flow calculations, it is more convenient to work in terms of $\overline{S_w}$ or the average water saturation in the swept zone using the following equation:

$$\overline{S}_o=1-\overline{S}_w \tag{10}$$

Based on fractional flow theory, average water saturation can be represented by:

$$\overline{S_w} = S_{w2} + \frac{(1-f_w)}{\frac{df_w}{dS_w}} \tag{11}$$

where $S_{w2}$ is the water saturation at the producing well, $f_w$ is the fractional flow at given watercut and $df^w/dS_w$ calculated at saturation $S_{w2}$. Fractional flow and the derivative of fractional flow can be calculated using the following equations and Corey model for relative permeability:

$$f_w = \frac{1}{\left(1+\frac{k_{ro2}}{k_{rw2}}\frac{\mu_w}{\mu_o}\right)} \tag{12}$$

$$k_{ro2} = k_{ro,i}\left(\frac{1-S_{w2}-S_{orw}}{S_{oi}-S_{orw}}\right)^{N_o} \tag{13}$$

$$k_{rw2} = k_{rw,Sor}\left(\frac{S_{w2}-S_{wc})}{1-S_{orw}-S_{wc}}\right)^{N_w} \tag{14}$$

Limited acid and asphaltene data was available, which along with oil and rock properties control wettability—which then influences Corey exponents and residual oil saturation. Because oil character is a major influence, three sets of relative permeability parameters were derived as a function of API and are shown in the table 2 below:

TABLE 2

| | Input SCAL parameters | | |
|---|---|---|---|
| | API Gravity | | |
| | <25 | 25-35 | >35 |
| Swc | 0.18 | 0.18 | 0.18 |
| Sorw | 0.19 | 0.19 | 0.19 |
| Soi | 0.82 | 0.82 | 0.82 |
| krw, sorw | 0.41 | 0.44 | 0.48 |
| kro, cw | 1.00 | 1.00 | 1.00 |
| Nw | 2.53 | 2.29 | 2.14 |
| No | 2.97 | 3.28 | 3.59 |

In this example, relative permeability parameters were assigned to each reservoir based on API and used to calculate remaining oil saturation at a given watercut.

Target Oil

Target oil represents the EOR potential for the reservoir and can be calculated as follows:

$$\text{TgtOil}=E_s*\overline{S}_o*RF*\text{STOIIP} \tag{15}$$

where $E_s$ represents volumetric sweep efficiency, $\overline{S}_o$ is remaining oil saturation at a given watercut and RF is the discount factor applied to account for the decrease in slim tube recovery at pressures lower than MMP.

$$RF=\text{Recovery}_{P_{op}}/\text{Recovery}_{MMP} \tag{16}$$

Sweep under gas flood is expected to be similar to sweep under water drive, which in viscous dominated cases is a good first approximation. Errors in STOIIP or sweep do not affect target oil calculations, as they are inversely proportional, so estimates using this method are valid for estimating target oil.

Project Timing

In this example, the screening tool requires user input of pilot injection rate and time frame to estimate total to be injected:

$$V=365.25TQB_g \tag{17}$$

where T is the injection time in years, Q is the gas injection rate in mscf/d and $B_g$ is the gas formation volume factor. Assuming one pore injected into the reservoir, the distance from injector to an observation well is calculated as follows:

$$L=\sqrt{\frac{5.615V}{\pi S_{oi}\phi h}} \tag{18}$$

This distance is compared to known well to well distances for each reservoir and requires a newly drilled well if the minimum spacing to inject one pore volume is exceeded. Well to well distances affects the gravity calculation and if a new well is required, this impacts cost of the pilot.

Gravity Override

The tendency of injected gas to gravity segregate can be estimated from the Lake Gravity Number, which is a ratio of particle movement laterally versus vertically and is given by:

$$G=\frac{t_{flowbetweenwells}}{t_{segregatevertically}}=\frac{k_v k_{rw}\Delta\rho g}{\mu_w}\frac{A_{cross\text{-}section}}{q}\frac{L}{h} \tag{19}$$

where Δpg is the density difference between gas and water (gas density is calculated from the NIST14 database for the different solvents for a given reservoir pressure and temperature), $k_v$ is the vertical permeability, $\mu_w$ is water viscosity (the reservoir at the start of gas flooding is mostly water), and q is injection rate. Low gravity number is more favorable in BDO reservoirs to achieve high vertical sweep efficiency. For each reservoir, a gravity number was calculated using the assumed well spacing for the pilot.

Capital Costs and Well Inventory

Location specific capital costs were developed for each field location. If the minimum required well spacing for the pilot was less than the current well spacing, the cost of one additional well was added to the facilities cost. For screening, a minimum of two wells is required for piloting, but may not reflect ultimate pilot design.

The cost of injectants is assumed to be the same for all cases and therefore was not included in the screening exercise. Areas with a large number of wells available have a high likelihood of finding suitable wells for a pilot and thus will be considered in the ranking.

Ranking Factors

In this example, a total score for each reservoir is calculated which is combination of normalized raw score for each category multiplied by a weighting factor.

$$S_{tot}=w_{TargetOil}S_{TargetOil}+w_{RecoveryFactor}S_{RecoveryFactor}+w_{Timing}S_{Timing}+w_{Gravity}S_{Gravity}+w_{Wells}S_{Wells} \tag{20}$$

The results presented assume the following weighting factors:

$w_{Targetoil}=4$
$w_{RecoveyFactor}=2$
$w_{Timing}=1$
$w_{Gravity}=1$
$w_{Wells}=1$ In this example target oil receives the highest ranking to focus on those reservoirs with the highest EOR potential. Recovery factor refers to the slim tube recovery factor discussed that discounts recovery for cases with operating pressure below MMP. Achieving miscibility in the reservoir is critical to ensure ideal displacement and therefore is weighted higher. Timing, gravity and wells all receive low weighting, as they are, to some extent, controllable either through drilling more wells or increasing injection rate.

A spreadsheet based screening tool was created to perform rapid screening under various criteria. The most recent reserves database was used as input data, which includes the following data items:

Field, Block and Reservoir Name
STOIIP
Estimated Ultimate Recovery from current operations
Current Cumulative Oil Production
Current Reservoir Pressure
Initial Reservoir Pressure
Reservoir Temperature
Oil API gravity
Gas-Oil ratio
Reservoir Depth The data was validated to the extent possible and not all reservoirs had a complete set of data above. For large fields, most data was present, although some reservoirs lacked critical data such as reservoir depth and initial pressure, which prevents the full range of screening.

Figure 7:
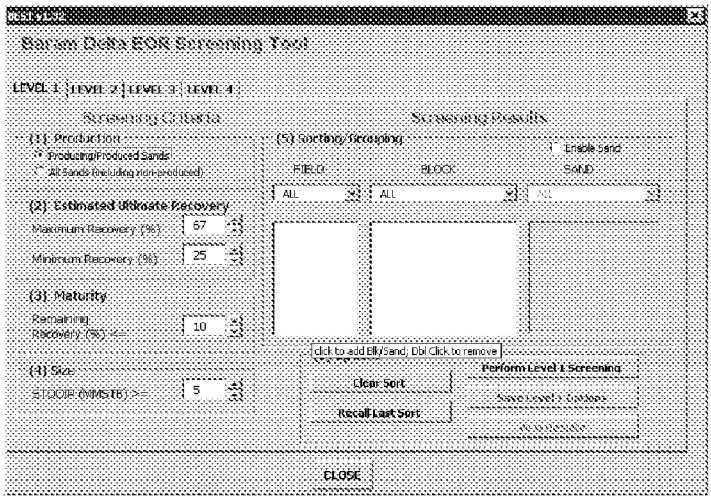
FIG. 7 shows an example of Level 1 screening options.
Figure 8:
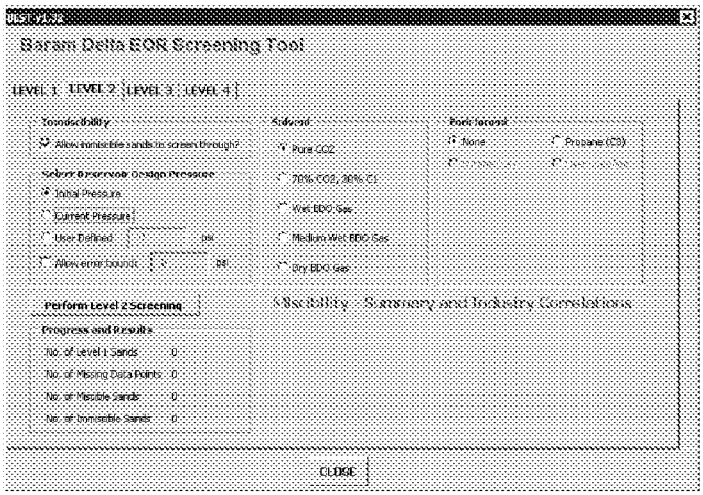
FIG. 8 shows an example of Level 2 screening options.
Figure 9:
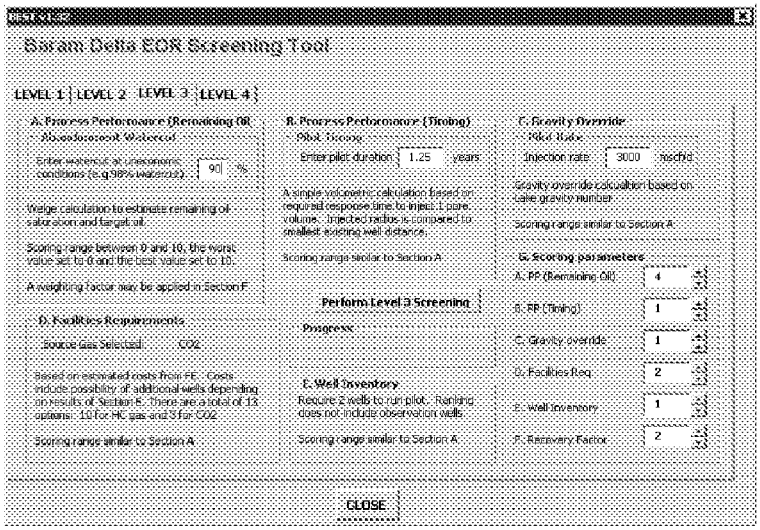
FIG. 9 shows an example of Level 3 screening options.

The tool follows the four levels described earlier with the options outlined below and shown in FIGS. 7 through 9. The choices made in each level control which reservoirs "pass" and continue on to the next level. For overall BDO wide EOR potential, all reservoirs pass Level 1.

Level 1; (a) field/block/sand to include, (b) specify min/max EUR, (c) max remaining reserves, (d) include/not include reservoirs never produced and (e) apply minimum STOIIP Level 2; (a) specify injectant composition, (b) specify whether gas is to be enriched; if enrich, then specify enrichment level or MME, (c) specify if immiscible candidates screen through, and (d) specify MMP error bound on MMP calculation that defines whether a reservoir is miscible or not Level 3; (a) specify abandonment watercut—used to estimate remaining oil saturation, (b) specify pilot duration, (c) specify gas injection rate, (d) source gas carried over from Level 2, and (e) weighting factors to be used in scoring Level 4; In this example, this was not employed. If this level were to be used, one would create a database of recovery curves, both modeled and actual, to compare calculated estimates to numerical simulation results 2. List Reservoirs in Order of Attractiveness for Eventual Full Scale Gas Injection The screening spreadsheet was first used to estimate total EOR for six BDO fields. All restrictions were removed allowing for all reservoirs to pass through. Of the 1,000+ reservoirs, only 123 reservoirs had sufficient data to do calculations; these reservoirs represent 52% of the total STOIIP. The values have been normalized against the total potential and shown in Table 3. The four highest EOR potential areas are highlighted below and include a mixture of both miscible and immiscible targets. West Lutong interestingly has both miscible and immiscible targets.

TABLE 3

Individual Field EOR Potential

| Field | Normalized EOR Potential | |
|---|---|---|
| | Miscible | Immiscible |
| Bakau | 0.01 | 0.00 |
| Baram | 0.38 | 0.01 |
| Fairley | 0.04 | 0.00 |
| Siwa | 0.00 | 0.01 |
| Tukau | 0.00 | 0.18 |
| West Lutong | 0.19 | 0.17 |

When considering different injectants, pure CO2 is the clear standout in terms of the largest EOR potential. All values are normalized against the highest reserves potential value (from CO2) in Table 4. Injecting dry gas or 90% methane reduces the overall potential by 35%.

TABLE 4

EOR Potential for Various Injectants

| Injected Gas | Normalized EOR Potential | | |
|---|---|---|---|
| | Miscible | Immiscible | Total |
| CO2 | 0.63 | 0.37 | 1.00 |
| 70% CO2, 30% C1 | 0.17 | 0.71 | 0.88 |
| 83% C1 | 0.00 | 0.74 | 0.74 |
| 90% C1 | 0.00 | 0.65 | 0.65 |

However, it is worth noting that similar potential as CO2 injection was obtained by enriching 83% methane gas with propane up to 30%.

A list of the top ranking candidates is shown in Table 5 below with those chosen for further static and dynamic modeling or Level 4 evaluation highlighted.

TABLE 5

Top EOR Potential Candidate List

| Field | Block | Tops |
|---|---|---|
| West Lutong | Block 1-MAIN | M/N |
| West Lutong | Block 1-MAIN | K/L |
| Tukau | Block 1 | J1/J9 |
| Baram | Block 4 | S8.1/S14.5 |
| Tukau | Block 2 | J2/J9 |
| Baram | Block 3 | S11.1/13.6 |
| Baram | Block 3 | S8.1/S9.2 |
| Baram | Block 2 | N1.0/O3.0 |
| Baram | Block 5 | S13.4/S14.1 |
| West Lutong | Block 1A-DEEP | U1/W |
| Tukau | Block 1 | E9/G3 |

3. Identify a Suitable Location for a Gas EOR Pilot & Identify a Suitable Injectant to Use for the Pilot The purpose of prototype modeling was to refine recovery estimates for the top ranking candidates in Level 3. No static or dynamic models exist for any of the fields considered. However, a recent completed field study of the nearby Bokor field was deposited in the same delta as the candidate fields and thus considered an adequate analogue to derive static model properties.

The process followed this approach:

Identify zones within the Bokor model of analogous depositional environment, e.g. shoreface, tidal channel, etc.

Import property grids into a proprietary model building software, and cookie cut out the model area and grid porosity sized specifically to the well spacing of interest; for instance the well spacing at West Lutong. Dozens of layer porosity grids were then exported for the different depositional environments.

Each field's layers assigned a depositional environment

Using the deckbuilder, customized prototype models were built as follows:

Grid layers added representing actual producing intervals

Layer porosity grids randomly selected from grids generated above—depositional environment dependent. Porosity distribution used to assign values, again by depositional and rock type Permeability assigned using field specific phi-k relationships derived from core Capillary pressure and relative permeability curves assigned to each grid cell—a function of permeability Well constraints applied from actual rates and pressures Field specific FWL applied Aquifer model applied where appropriate

TABLE 6

Comparison of recovery, CO2 injection-80% HCPV Injected

| Field | Block | Tops | Level 3 Incremental Recovery Factor (%) | Simulation Incremental Recovery Factor (%) |
|---|---|---|---|---|
| West Lutong | Block 1 | KL | 24% | 8% |
| West Lutong | Block 1 | MN | 20% | 10% |
| Tukau | Block 1 | E9/G3 | 10% | 6% |
| Tukau | Block 1 | J1/J9 | 12% | 17% |
| Baram | Block 4 | S8.1/S14.5 | 15% | 14% |

TABLE 7

Comparison of recovery, 35% Propane enriched HC Gas-80% HCPV Injected

| Field | Block | Tops | Level 3 Incremental Recovery Factor (%) | Simulation Incremental Recovery Factor (%) |
|---|---|---|---|---|
| West Lutong | Block 1 | KL | 29% | 11% |
| West Lutong | Block 1 | MN | 21% | 14.1% |
| Tukau | Block 1 | E9/G3 | 11% | 12.8% |
| Tukau | Block 1 | J1/J9 | 16% | 19.6% |
| Baram | Block 4 | S8.1/S14.5 | 15% | 16.1% |

The cases that correlated best with Level 3 estimates were fully miscible or operating at a pressure well above MMP. Cases such as West Lutong K/L operating ~400 psi below MMP, considered immiscible, shows a significantly lower recovery factor reflecting impaired sweep efficiency similar to the dry gas floods. West Lutong M/N operated at near miscible conditions, within 100 psi of MMP.

The choice of pilot location narrowed to two candidates, Baram S8 and West Lutong M/N. Tukau J1/J9, although showed promising incremental recovery, applies only to a small portion of the Tukau STOIIP, which is largely comprised of heavier oil. Baram and West Lutong miscible/near miscible candidates represent almost ⅔ of all EOR potential of the six fields considered.

In an attempt to further differentiate the two final candidates, five key criteria were reviewed and are shown in Table 8.

TABLE 8

Comparison of top candidates for pilot selection

| Ranking Parameters | Baram | West Lutong |
|---|---|---|
| 1. EOR potential | 3 | 2 |
| 2. Structural simplicity | 1 | 3 |
| 3. Cost | 2 | 2 |
| 4. Producer pilot well spacing | 1 | 1 |
| 5. Pilot economics | 3 | 2 |
| Total | 10 | 10 |

Legend
1 = Poor
2 = Fair
3 = Good
4 = Excellent

Although the data indicates that both opportunities could be pursued, the screening tool and method provides the operator with enough information to make a reasonable decision. The same screening tool and method have been used with success to select EOR candidates in various other reservoirs.

The invention claimed is:

1. A method for estimating minimum miscibility enrichment (MME) for an injectant used in gas flooding of a reservoir at a given operating pressure comprising:

performing a plurality of slim tube simulations for the reservoir;

determining minimum miscibility pressure (MMP) for each of a plurality of injected gases in the reservoir;

creating a plot having a recovery factor (RF) vs. 1−(MMP−P)/MMP curve for each of the plurality of injected gases, wherein P is the operating pressure of the reservoir having at least one of the plurality of injected gases, wherein 1−(MMP−P)/MMP is a dimensionless pressure, wherein MMP is the minimum miscibility pressure of one of the plurality of injected gases from the determining step, and wherein the plot has a y-intercept and slope;

combining all of the RF vs. 1−(MMP−P)/MMP curves for each of the plurality of injected gases to form one curve;

obtaining a recovery factor equation RF=i+s(1−(MMP−P)/MMP) from the one curve, wherein i is the y-intercept and s is the slope;

determining a value for i;

determining a value for s; and calculating the recovery factor.

2. The method of claim 1 further comprising:

calculating $MMP_{ne}$, wherein $MMP_{ne}$ is the minimum miscibility pressure for at least one of the plurality of injected gases when it has not been enriched;

rewriting the recovery factor equation to represent a recovery factor for the injected gas when it has not been enriched ($RF_{ne}$,);

setting $RF_{ne}$,=$RF_{max}$ wherein $RF^{max}$ is a maximum recovery factor; and estimating minimum miscibility enrichment (MME).

3. The method of claim 2 wherein $i=0.1828-0.42617X_{C3}$, wherein $X_{C3}$ , is the mole fraction of the injectant.

4. The method of claim 3 wherein $s=0.8172+1.5956X_{C3}+7.1929X_{C3}^2$.

5. The method of claim 4 wherein rewriting the recovery factor equation further comprises:

rewriting the recovery factor equation as $$RF_{ne}=0.1828-0.4262X_{C3,ne}+(0.8172+1.5956X_{C3,ne}+7.1929X_{C3,ne}^2)P_d$$

wherein $$P_d=1-(MMP_{ne}-P_{op})/MMP_{ne}$$

wherein $P_{op}$ is the given operating pressure.

6. The method of claim 5 wherein estimating the minimum miscibility enrichment (MME) further comprises:

obtaining the MME equation $$7.1929P_dX_{MME}^2+(1.5956Pd-0.4262)X_{MME}+(0.1828+0.8172P_d-RF_{max})=0$$

wherein $X_{MME}$ is the minimum miscibility enrichment (MME); and solving for $X_{MME}$.

* * * * *